US005322095A

United States Patent [19]

Bolz

[11] Patent Number: 5,322,095

[45] Date of Patent: Jun. 21, 1994

[54] FILLING PLANT FOR HAZARDOUS MEDIA

[75] Inventor: Volker Bolz, Wangen/Allagau, Fed. Rep. of Germany

[73] Assignee: Alfred Bolz GmbH & Co. KG, Fed. Rep. of Germany

[21] Appl. No.: 898,425

[22] Filed: Jun. 15, 1992

[30] Foreign Application Priority Data

Jun. 25, 1991 [DE] Fed. Rep. of Germany ... 9107768[U]

[51] Int. Cl.[5] ..... B65B 31/00; B65B 3/04; B25J 21/02

[52] U.S. Cl. ..... 141/83; 141/65; 141/93; 141/97; 141/287; 141/315; 312/1; 454/56

[58] Field of Search ..... 141/10, 65, 83, 93, 141/97, 98, 114, 287, 312-317, 368-370, 379; 134/200, 201; 312/1; 454/56, 65; 588/249, 259

[56] References Cited

U.S. PATENT DOCUMENTS

| | | | |
|---|---|---|---|
| 2,262,620 | 11/1941 | Newman | 248/99 |
| 2,513,143 | 6/1950 | Carter | 141/287 |
| 3,785,410 | 1/1974 | Carter | 141/10 |
| 4,344,468 | 8/1982 | Sandberg | 141/114 X |
| 4,417,607 | 11/1983 | Scholle et al. | 141/10 X |
| 4,467,845 | 8/1984 | Strand et al. | 141/10 |
| 4,625,494 | 12/1986 | Iwatschenko et al. | 53/432 |
| 4,648,432 | 3/1987 | Mechalas | 141/10 X |
| 4,842,347 | 6/1989 | Jacobson | 312/1 |
| 4,872,493 | 10/1989 | Everman | 141/59 |
| 4,960,143 | 10/1990 | Dore, Jr. et al. | 134/200 X |
| 4,991,633 | 2/1991 | Wong | 141/5 |

FOREIGN PATENT DOCUMENTS

| | | |
|---|---|---|
| 0346610 | 5/1989 | European Pat. Off. . |
| 0381020 | 1/1990 | European Pat. Off. . |
| 2851184 | 9/1984 | Fed. Rep. of Germany . |
| 1574369 | 7/1969 | France . |
| 8600422 | 6/1987 | PCT Int'l Appl. . |
| 822674 | 10/1959 | United Kingdom . |
| 1411256 | 10/1975 | United Kingdom . |

*Primary Examiner*—J. Casimer Jacyna
*Attorney, Agent, or Firm*—Brown, Martin, Haller & McClain

[57] ABSTRACT

A filling plant for filling bags with hazardous bulk or fluid media is designed to ensure that the medium to be filled is proportioned and packaged under clean room conditions in a bag filling plant at the outlet of a production plant for the hazardous medium. The outlet opening of the production plant communicates with a hermetically sealable container into which the hazardous medium can pass and in which the filling plant and a bag to be filled are disposed.

9 Claims, 1 Drawing Sheet

FILLING PLANT FOR HAZARDOUS MEDIA

FIELD OF THE INVENTION

The present invention relates to a plant for filling bags with a hazardous medium, to be proportioned and packaged under safe conditions at the outlet of a plant for the production of said medium.

BACKGROUND OF THE INVENTION

In known filling plants of this type highly active pulverulent or fluid media are refilled or repackaged, especially in the pharmacological and chemical processing industry, in a "clean room", that is to say in a hermetically sealed room.

Such media are prepared for example in screw mixers, filter arrangements, agitator vats and the like and are then filled into bags under hermetically sealed conditions, that is to say in a clean room in order to protect the personnel carrying out the filling operations from exposure to the hazardous media. Even so the operating personnel of the filling plant may need to wear protective suits in order to avoid contact with the hazardous media.

According to such known practice, the clean room must also be provided with appropriate external ventilation in the same way that the "space suits" of the operating personnel must be provided with appropriate breathing helmets and external ventilation.

SUMMARY OF THE INVENTION

It is an object of the present invention, therefore, to provide a filling plant in which the filling of hazardous media into bags can be carried without danger to personnel and at substantially reduced cost.

According to the present invention there is provided a filling plant for hazardous bulk or fluid media, in which the medium to be filled is proportioned and packaged under clean room conditions in a bag filling plant at the outlet of a production plant, wherein the outlet opening of the production plant, for example a conical screw mixer, flows into a hermetically sealable container in which the filling plant is arranged.

As disclosed herein the hermetically sealable container has an upper wall having an inlet opening for the hazardous medium to be packaged, and an inner space in which the filling plant is disposed.

Windows are provided in the container in order to enable observation at the filling process and the container has hand access openings to which protective gloves are connected in order to allow personnel to manipulate a filling and weighing unit within the container.

No special protective gear is required for the operating personnel and a so-called clean room is not needed. The container permits reliable compartmentalisation of hazardous media and ensures safe loading and unloading thereof.

The container is preferably connected to a low pressure system for preventing hazardous material from leaking out of the container should its sealing become defective.

Such a container can be easily cleaned from the inside so that operation of the filling plant need be interrupted only for a short period when the hazardous medium to be packaged is to be changed.

Such containers are economical both to produce and to operate.

The media to be packaged may comprise bulk or fluid material, such as pulverulent material, granular substances, liquid materials and paste-like materials.

A conical screw mixer, for producing a hazardous medium may be seated with its outlet opening directly against the inlet opening of the container.

Metering of the medium, that is to say the determination of the quantity of the medium which is to be introduced into the container, is preferably effected on the manufacturing side. The underside of the conical screw mixer may to this end be provided with a spherical segment valve for allowing a specific quantity of the medium to flow into an outlet opening having a metering valve arranged therebeneath.

The spherical segment valve is arranged only to hermetically seal the base opening of the conical screw mixer, the metering of the medium being achieved by means of the metering valve which is disposed downstream of said base opening.

This metering valve may be seated directly at the inlet opening of the container, beneath which opening the packaging and weighing unit is disposed.

According to an embodiment thereof the packaging and weighing unit consists of an inflatable sealing part, arranged on the inlet side, which provides a hermetic seal about a flange connected to the inlet opening of the container for the attachment of a bag to said sealing part.

The bag is preferably received in a drum container, for protective reasons.

The drum container may be double walled, having a relatively rigid outer wall consisting, for example, of plastics, paper or metal, and an inner wall in the form of a protective cover. The bag is located in the drum container, which rests on a weighing and lifting system, with the upper open end of the bag suspended from said inflatable sealing part. The upper end of the drum container projects through an opening in a plate which divides the sealable container int upper and lower chambers. The sealing part is now inflated and so holds the bag sealingly on the underside of said flange which is connected to the inlet opening of the sealable container.

When the bag to be filled has been so connected, the spherical segment valve is opened and then the metering valve is operated in order to allow a given, metered quantity of the hazardous medium to flow into the bag by way of the now open inlet opening of the sealable container and into the flange.

The medium collects in the bag in the drum container until a predetermined weight has been measured by the weighing and lifting system on which the drum container is seated.

When the required weight of the medium has been received in the bag, the metering valve is closed and then any excess air is sucked from within the bag by means of a ventilating pipe arranged in the flange beneath the inlet opening of the sealable container. The bag is thereby deflated and can then be sealed with the inflatable sealing part still holding the bag hermetically sealed against the underside of the flange. The bag is then tied up and is severed above the position at which it is tied up. The severed upper part of the bag remains suspended from the inflatable seal, while the lower part of the bag, which has been tied up, rests in the drum container.

By way of the hand access openings in the sealable container, the bag is stuffed by hand into the drum container, in which the bag is enveloped by the inner protective cover of the drum container.

The weighing and lifting system now lowers the drum container thereon and a protective lid pivotally arranged in the container is swung onto the opening in said plate which divides the sealable container into two chambers, the protective lid seals this opening, through which the upper end of the drum container projected before the drum container was lowered.

The sealable container is again placed under low pressure as before and a loading aperture in a side wall of the sealable container is opened and the drum container with the filled bag contained therein is removed from the container, by way of the loading aperture. The protective lid prevents unintended discharge of the hazardous medium after the drum container has been lowered. A new drum container containing a bag to be filled is then placed on the weighing and lifting system, by way of the loading aperture.

The loading aperture is closed and the protective lid is swung away from said opening in said plate, so that when the drum container is raised by means of the weighing and lifting system the drum container protrudes through that opening.

Manually, by means of said protective gloves, the new bag to be filled is connected to said inflatable sealing part and that sealing part is inflated.

The new bag is now filled in the manner described above.

By virtue of the present invention the filling of the bags takes place entirely under clean room conditions and under stringent protective precautions without the need for a large clean room with operating personnel therein to be protected.

The filling plant can be used not only for filling the bags with fluid, that is to say pulverulent and granular substances, but also liquid and paste-like materials.

The operation of the filling plant will now be summarized. As aforesaid, the sealable container is divided into said two chambers by means of said plate. The upper chamber is provided with the means described above for holding the bag on the flange extending from the inlet opening of the sealable container, while the lower chamber receives the drum container. While the bag is being filled the two chambers communicate with each other so that the bag protrudes through the opening in said plate, which opening connects the upper chamber with the lower chamber.

After the evacuation of the filled bag has been completed and after it has been tied up and severed, the separation of said chambers is effected by hand, the tied up bag is stuffed into the drum container, as is the protective cover of the drum container, and the drum container is then closed by means of said protective lid. The drum container is then lowered and the opening between the two chambers is closed. The upper chamber of the sealable container is now separated from the lower chamber by means of the protective lid which is, as aforesaid, pivotally arranged in the sealable container. The closed drum container is accordingly available in the lower chamber for removal through said loading aperture.

The separation of the sealable container into two chambers arranged horizontally above one another, and whose communication can be closed off by the protective lid, has the advantage that contamination of the upper chamber cannot be transferred to the lower chamber.

The sealable container may be combined with further sealable containers connected thereto in hermetically sealed fashion.

This enables the bag filling processes described above to be automatically carried out. The removal of the filled drum container is not, in this case, effected by hand by way of a loading aperture. Instead the drum container is conveyed by machinery into a further sealable container which may have a pressure or cleaning sluice.

BRIEF DESCRIPTION OF THE DRAWING

The single FIGURE is an isometric view, with parts removed, of a bag filling plant according to a preferred embodiment of the invention.

DETAILED DESCRIPTION OF THE PREFERRED EMBODIMENT OF THE INVENTION

Figure 1:
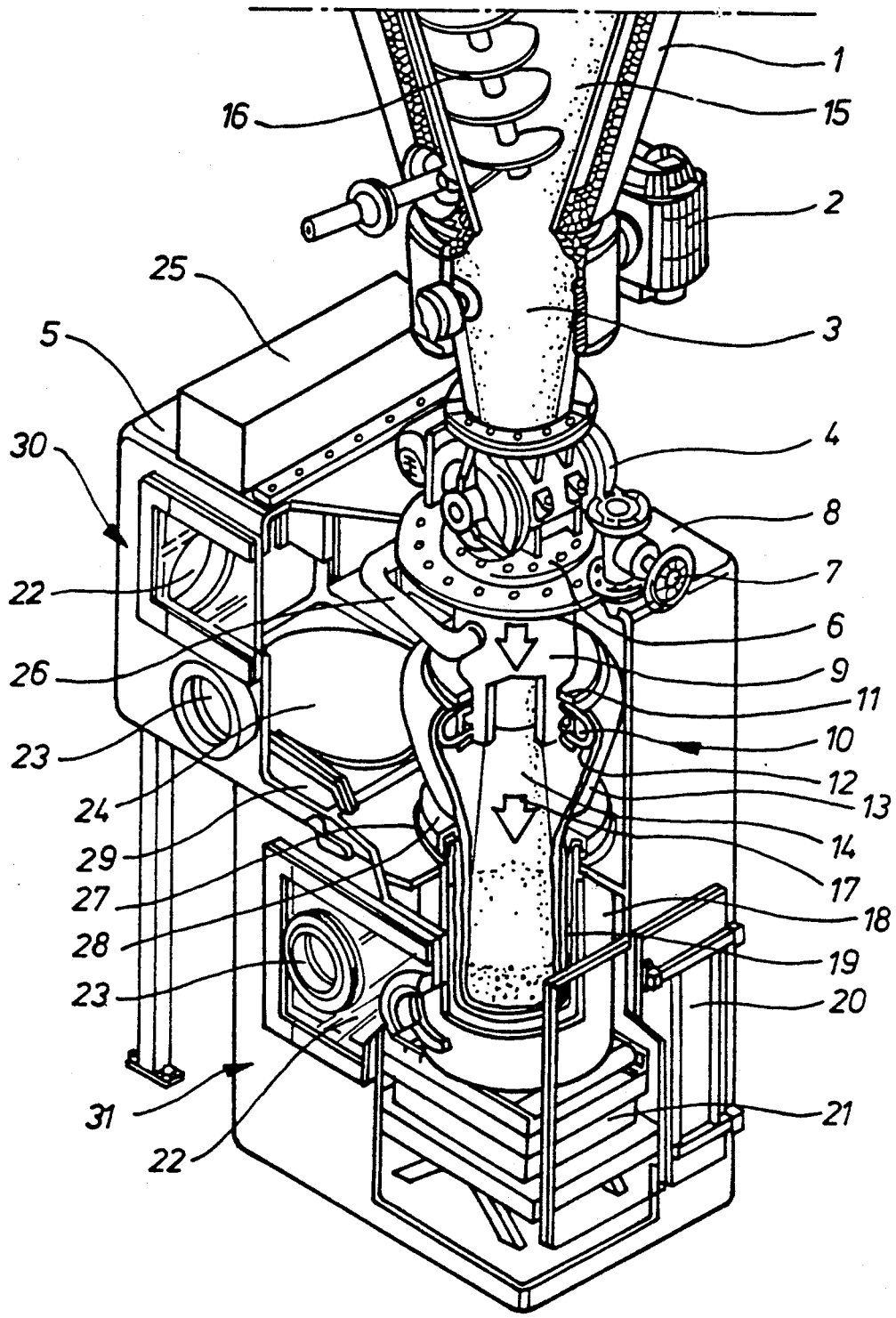

A conical screw mixer 1, only the bottom part of which is shown, has an inner chamber within which the usual mixing screw 16 is rotatable about its own axis.

The conical screw mixer 1 has a base opening provided by a spherical segment valve 2 which opens into an outlet opening 3 which is closed from below by a metering valve 4. The metering valve 4 is directly seated on a flange 6 defining an inlet opening of a main container 5 which is constructed as a hermetically sealed "clean room" container, within which a hazardous medium 15 is to be bagged and weighed as described below.

The container 5 has walls defining windows 22 and hand access openings 23 to which protective gloves (not shown) are connected within the container 5 and are hermetically sealed from the outside atmosphere.

Since as aforesaid the bag filling and weighing process take place within the container 5, none of the hazardous medium 15 can escape into the surrounding environment.

There is provided on the underside of the flange 6 a flange 9 which is in the form of a double flange. This is necessary for ventilating the interior of a bag 13 to be filled with the hazardous medium.

On the outer circumference of the flange 9 is an inflatable sealing part 10 which essentially consists of a pair of flanges 11 between which is received an inflatable sealing tube 12.

The upper part of the bag 13 to be filled is arranged about the outer circumference of the sealing tube 12.

Within the container 5 is a double-walled drum container 18 having an outer cover consisting of a rigid material, and an inner protective cover 19 defining an inner chamber, said covers being held together by means of a closure flange 28.

The drum container 18, the inner chamber of which contains the bag 13 to be filled, stands on a weighing and lifting system 21.

The drum container 18 projects through a closable opening 27 in a plate 29 in the container 5. The plate 29 divides the container 5 into two superpositioned, upper and lower chambers 30 and 31, respective, which communicate with each other by way of the closable opening 27. The opening 27 can be closed by means of a protective lid 24 pivotally mounted in the container 5.

The bag 13 having been filled, as described below, drum container 18 can be removed from the main container 5 through a loading aperture 20 in a wall of the lower chamber 31 and a further drum container containing an empty bag to be filled, can then be introduced through the aperture 20.

The filling process will now be described.

After the spherical segment valve 2 has been opened and the metering valve 4 has been put in operation, a precisely measured quantity of said medium 15 is conveyed by the conical screw mixer 16 by way of the metering valve 4 and the inlet opening defined by the flange 6 through the flange 9 from whence a stream 14 of the medium 15 flows in the direction of the arrow 17 into the bag 13 which is to be filled.

As soon as the weighing and lifting system 21 has determined the required weight of the medium 15 with which the bag 13 is to be filled, the stream 14 is stopped and air is pumped from the interior of the bag 13, in order to evacuate the bag 13, by way of a ventilating pipe 26 which leads into the flange 9. The bag 13, therefore, contracts so that it can be tied up. After being tied up, the bag 13 is severed between the lower edge of the flange 9 and position at which the bag 13 is tied up and the severed and tied up part of the bag 13 is stuffed fully into the drum container 18. The closure flange 28 is removed and the protective cover 19 is similarly tied up and is stuffed into the drum container 18. The weighing and lifting system 21 lowers the drum container 18. The drum container 18 is then closed manually by means of a lid (not shown) loosely arranged in the container 5, by way of the access openings 23.

The protective lid 24, which rests on the plate 29, is then swung into its closure position so that it covers the opening 27 in the plate 29, whereby the medium 15 is prevented from flowing or trickling from above onto the closed drum container 18. The upper chamber 30 is accordingly separated from the lower chamber 31.

The loading aperture 20 in the lower chamber 31 is now opened, and the closed drum container 18 is removed from the container 5, and a new drum container 18 is placed on the weighing and lifting system 21, by way of the open aperture 20.

The loading aperture 20 is then closed again and the lid of the new drum container 18 is removed. The lid 24 is swung to its open position. The weighing and lifting system 21 is then activated so that the new drum container 18 in the filling position, is passed through the opening 27, which is free of the protective lid 24. The upper part of the new bag 13 to be filled is now manually positioned, by way of hand access openings 23, on the inflatable sealing part 10 which remains deflated, and the sealing part 10 is then reinflated in order to secure the upper part of the bag 13. The new bag 13 is then filled with the medium 15 in the manner described above.

For protective reasons the container 5 also has a suction and ventilating valve 7.

Also provided is a vortex valve at a position referenced 8, but which is not shown in the drawing. The vortex valve ensures that in the event of the container 5 leaking, air is sucked up by means of the vortex valve 8 and the low pressure in the container is raised to such an extent that none of the medium can escape from the container 5. A control box 25 containing appropriate regulating and control devices, such as for example valves, control elements, scales and the like, is fixed to the top of the main container 5.

The container 5 need not necessarily cooperate with a conical screw mixer as described above, but can be used with any other suitable dispenser for the hazardous medium. Instead of the containers 5 described herein other analogous apparatus used in processing technology, may be employed.

What is claimed is:

1. Apparatus for filling bags with a hazardous medium to be proportioned and packaged at the outlet of a plant for production of said medium, comprising:

a hermetically sealable main container having an inlet opening for communication with the outlet of a production plate for producing a hazardous medium;

the main container having a flange at said inlet opening, said flange comprising means for sealing attachment to a bag for filling with said hazardous medium;

a horizontal plate extending across the interior of the main container and separating the main container into an upper chamber and a lower chamber, the plate having an opening, and a protective lid pivotally mounted in the main chamber for closing said opening; and a drum container in said lower chamber for receiving the lower end of a bag attached to said flange.

2. Apparatus as claimed in claim 1, wherein said flange is provided with an inflatable sealing member for sealingly engaging the interior of said bag.

3. Apparatus as claimed in claim 1, wherein said drum container is double walled, comprising an outer cover, and an inner protective cover for encasing said bag.

4. Apparatus as claimed in claim 1, comprising means maintaining the interior of the main container under low pressure, walls of the main container defining windows and hand access through openings, protective gloves projecting into the interior of the main container hermetically sealing said access openings.

5. Apparatus as claimed in claim 1, wherein the outlet opening of the production plant is the outlet opening of a conical screw mixer.

6. Apparatus as claimed in claim 1, wherein said hazardous medium is selected from the group consisting of pulverulent substances, granular substances, liquid materials and paste-like materials.

7. The apparatus as claimed in claim 1, wherein the drum container extends through said opening in said horizontal plate and has an upper open end in releasable sealing engagement with said opening in said horizontal plate.

8. The apparatus as claimed in claim 1, including a weighing unit in said lower chamber supporting said drum container.

9. Apparatus as claimed in claim 8, wherein the weighing unit is constructed for lifting and lowering said drum container.

* * * * *